US006472965B2

(12) United States Patent
Leone et al.

(10) Patent No.: US 6,472,965 B2
(45) **Date of Patent: *Oct. 29, 2002**

(54) MOLDED CASE CIRCUIT BREAKER ACCESSORY SYSTEM

(75) Inventors: David A. Leone, Lilburn, GA (US); Peter P. Clickner, Lawrenceville, GA (US); Russell Green, Douglasville, GA (US); Mauricio Rodriguez, Duluth, GA (US)

(73) Assignee: Siemens Energy & Automation, Inc., Alpharetta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/434,568

(22) Filed: Nov. 5, 1999

(65) Prior Publication Data

US 2002/0050886 A1 May 2, 2002

(51) Int. Cl.[7] ..... H01H 67/02; H01H 9/02

(52) U.S. Cl. ..... 335/202; 335/6; 335/162; 335/132; 200/293; 200/295

(58) Field of Search ..... 335/132, 162, 335/202; 200/293–308

(56) References Cited

U.S. PATENT DOCUMENTS

| | | | | | |
|---|---|---|---|---|---|
| 4,622,444 | A | * | 11/1986 | Kandatsu et al. | 200/303 |
| 4,864,263 | A | * | 9/1989 | Castonguay et al. | 335/167 |
| 4,887,055 | A | | 12/1989 | Male | 335/6 |
| 5,107,236 | A | * | 4/1992 | Lesslie et al. | 335/132 |
| 5,440,088 | A | | 8/1995 | Coudert et al. | 200/303 |
| 5,539,168 | A | | 7/1996 | Linzenich | 200/303 |
| 5,581,219 | A | | 12/1996 | Nozawa et al. | 335/132 |

* cited by examiner

*Primary Examiner*—Ramon M. Barrera
(74) *Attorney, Agent, or Firm*—Foley & Lardner

(57) ABSTRACT

The present invention provides a circuit breaker (10) and a cover (20) for a molded case circuit breaker having an operating mechanism (40) and an intermediate latching mechanism (52) with the cover (20) comprising a substantially planer member having a central opening (29) and an accessory compartment (22) formed in the planer member on either side of the opening (29) with the accessory compartment (22) configured to accept a plurality of different types of accessories (20) and having a plurality of holes (24) wherein a circuit breaker accessory (80) is nested in the accessory compartment (22) and is in contact with one of the operating mechanism (40) and the intermediate latching mechanism (52) within the housing (12).

19 Claims, 5 Drawing Sheets

FIG. 5
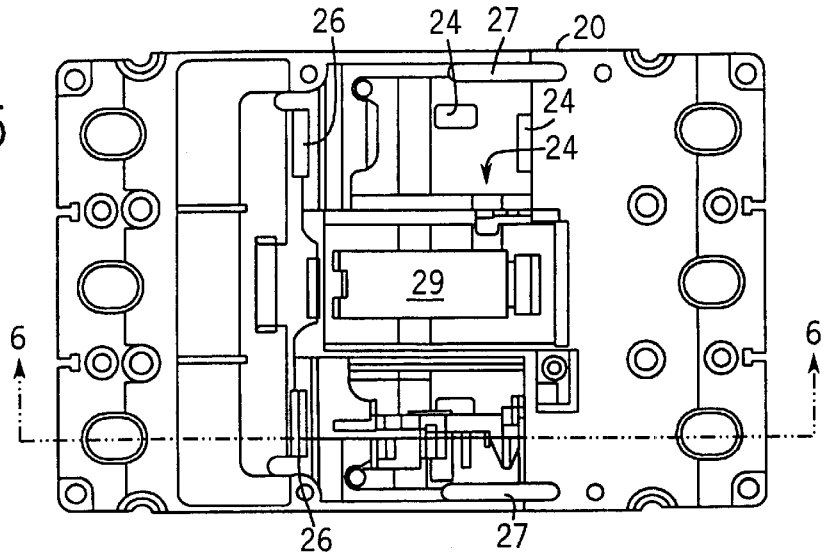
FIG. 6
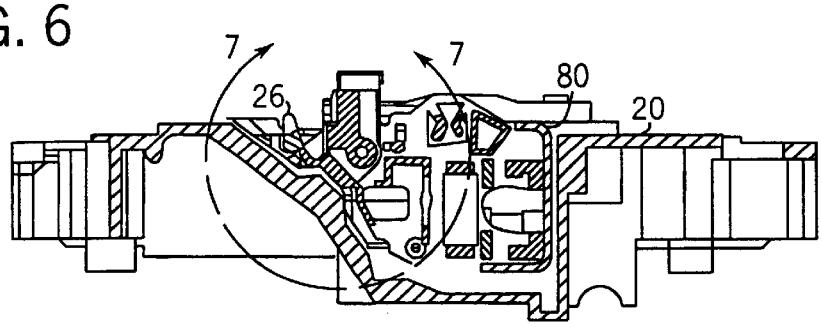
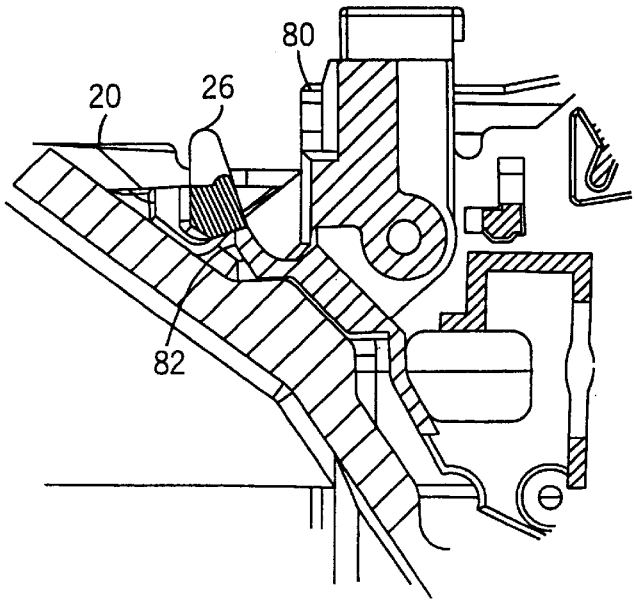
FIG. 7

MOLDED CASE CIRCUIT BREAKER ACCESSORY SYSTEM

FIELD OF THE INVENTION

This invention relates to a circuit breaker, and more particularly, to a molded case circuit breaker accessory system.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

Various accessories are used with a circuit breaker, such as alarm, auxiliary switches, and the like. The accessories are typically mounted in the circuit breaker frame and can be serviced only by removing the circuit breaker cover thereby exposing electrically live parts. Some circuit breakers provide accessory pockets dedicated to a single type of accessory, thereby preventing other accessories from being used in that pocket. Such arrangements eliminate flexibility and increase costs since a different circuit breaker with its dedicated accessories must be used for a particular purpose.

This there is a need for a molded case circuit breaker capable of using interchangeable internal accessories in the same accessory compartment in the circuit breaker cover without exposing the live electrical connections of the circuit breaker. There is also a need for a molded case circuit breaker that can be reconfigured to provide different functions without modifying the circuit breaker latching mechanism.

SUMMARY OF THE INVENTION

One embodiment of the invention relates to the molded case circuit breaker comprising a molded housing including a main breaker cover with a first terminal and a second terminal mounted in the case. The stationary contact electrically coupled to the first terminal and a movable contact electrically coupled to the second terminal is also provided. An operating mechanism having a pivoting member movable between an ON position, an OFF position and a TRIPPED position, is coupled to the movable contact. An intermediate latching mechanism is mounted in the housing and coupled to the operating mechanism. The trip unit is coupled to the movable contact and the second terminal with the trip unit in selective operative contact with the intermediate latching mechanism. The main breaker cover is provided with an accessory compartment system comprising an accessory socket formed in the main cover on either side of an opening for the pivoting member with the accessory socket in communication with the housing and configured to accept a plurality of different types of accessories. A latching protrusion is mounted in the socket for engaging the accessory. A separate accessory cover sized to cover the accessory mounted in the accessory socket is attached to the breaker cover.

Another embodiment of the present invention presents a cover for a molded case circuit breaker having an operating mechanism and an intermediate latching mechanism with the cover comprising a substantially planer member having a central opening and an accessory compartment formed in the planer member on either side of the opening with the accessory compartment configured to accept a plurality of different types of accessories and having a plurality of holes wherein a circuit breaker accessory is nested in the accessory compartment and is in contact with one of the operating mechanism and the intermediate latching mechanism.

BRIEF DESCRIPTION OF THE DRAWINGS

FIG. 5 is a top plan view of the main breaker cover illustrated in FIG. 4.

FIG. 6 is a sectional side view of the breaker cover illustrated in FIG. 5 along the line 6—6.

FIG. 7 is an enlarged, partial sectional side view of area identified in FIG. 6 illustrating the latching protrusion engaging an accessory detent.

DETAILED DESCRIPTION OF THE PREFERRED EMBODIMENTS

Figure 1:
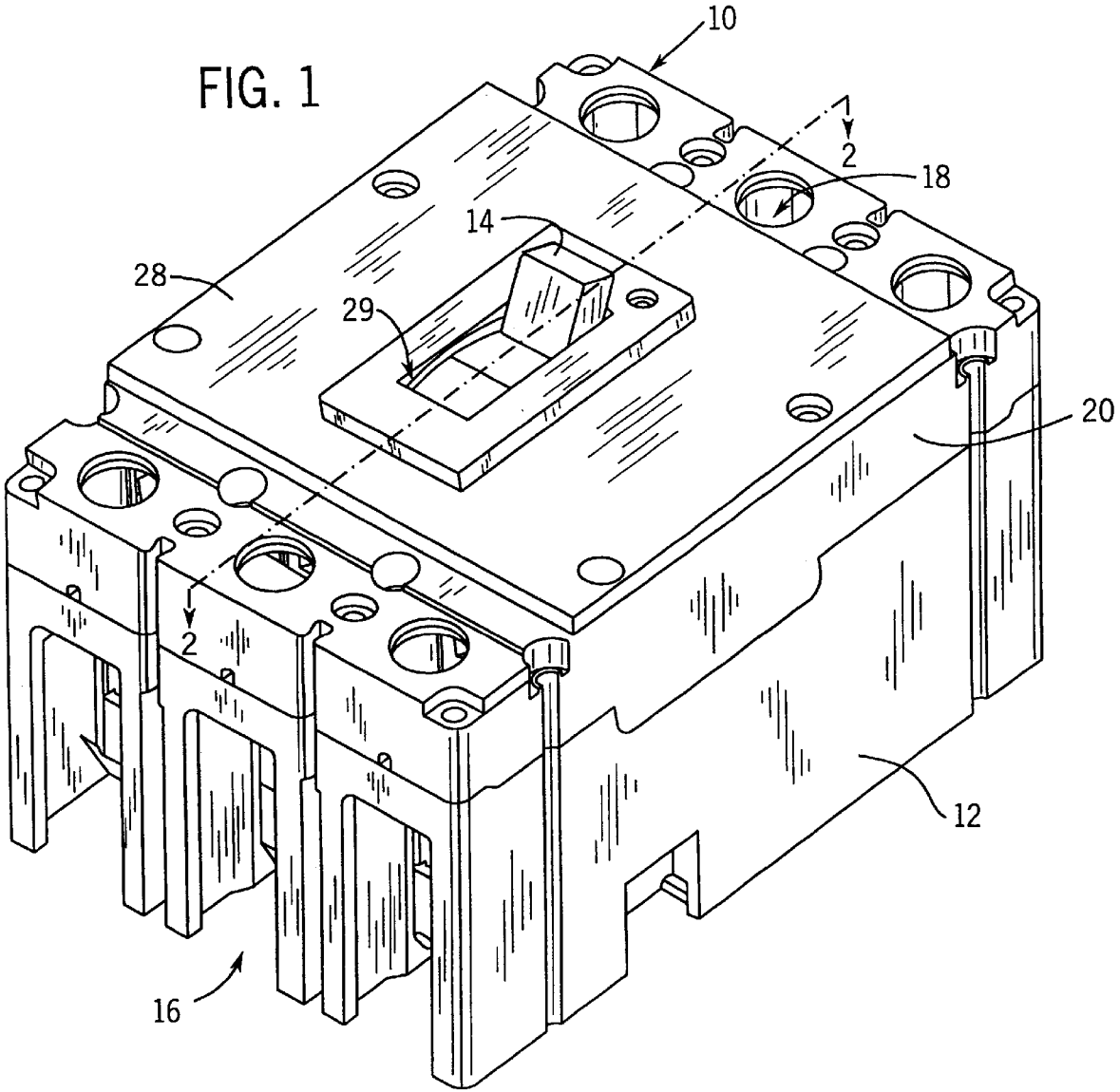
FIG. 1 is an isometric drawing of a molded case circuit breaker which includes an embodiment of the present bi-metal unit capable of broad rating applications.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
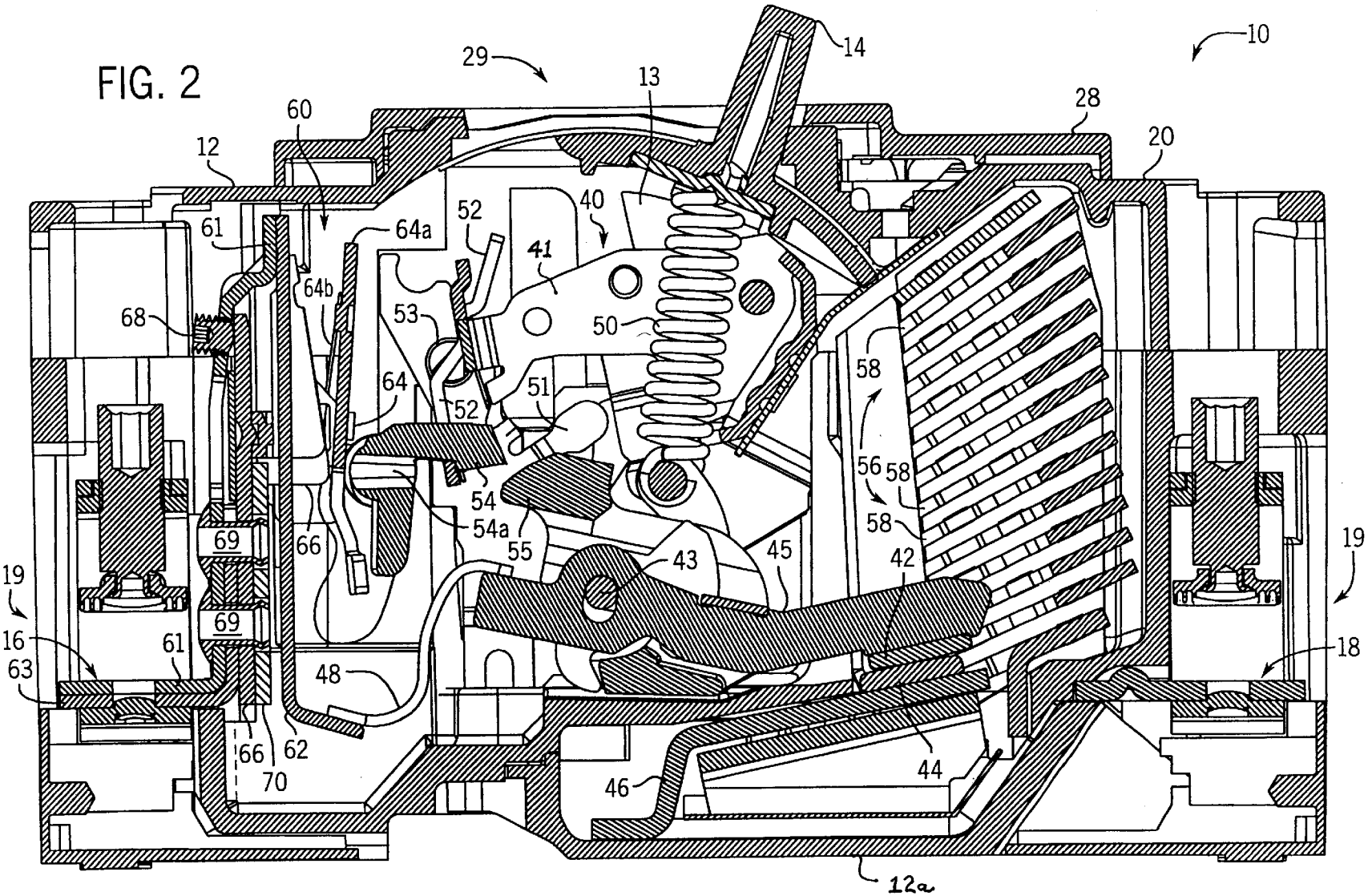
FIG. 2 is a section view of the circuit breaker shown in FIG. 1 along the lines 2—2 and is used to describe the operation of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, a circuit breaker cover 20 and an accessory cover 28 with breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a,* responsive to a force exerted by a bimetallic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bi-metallic element 62 and from the bi-metallic element 62 to the load terminal 16. (See FIG. 3) When the current flowing through the circuit breaker exceeds the rated current for the breaker, it heats the bi-metallic element 62, causing the element 62 to bend towards the trip bar 54. If the over current condition persists, the bi-metallic element 62 bends sufficiently to engage the trip bar surface. As the bi-metallic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
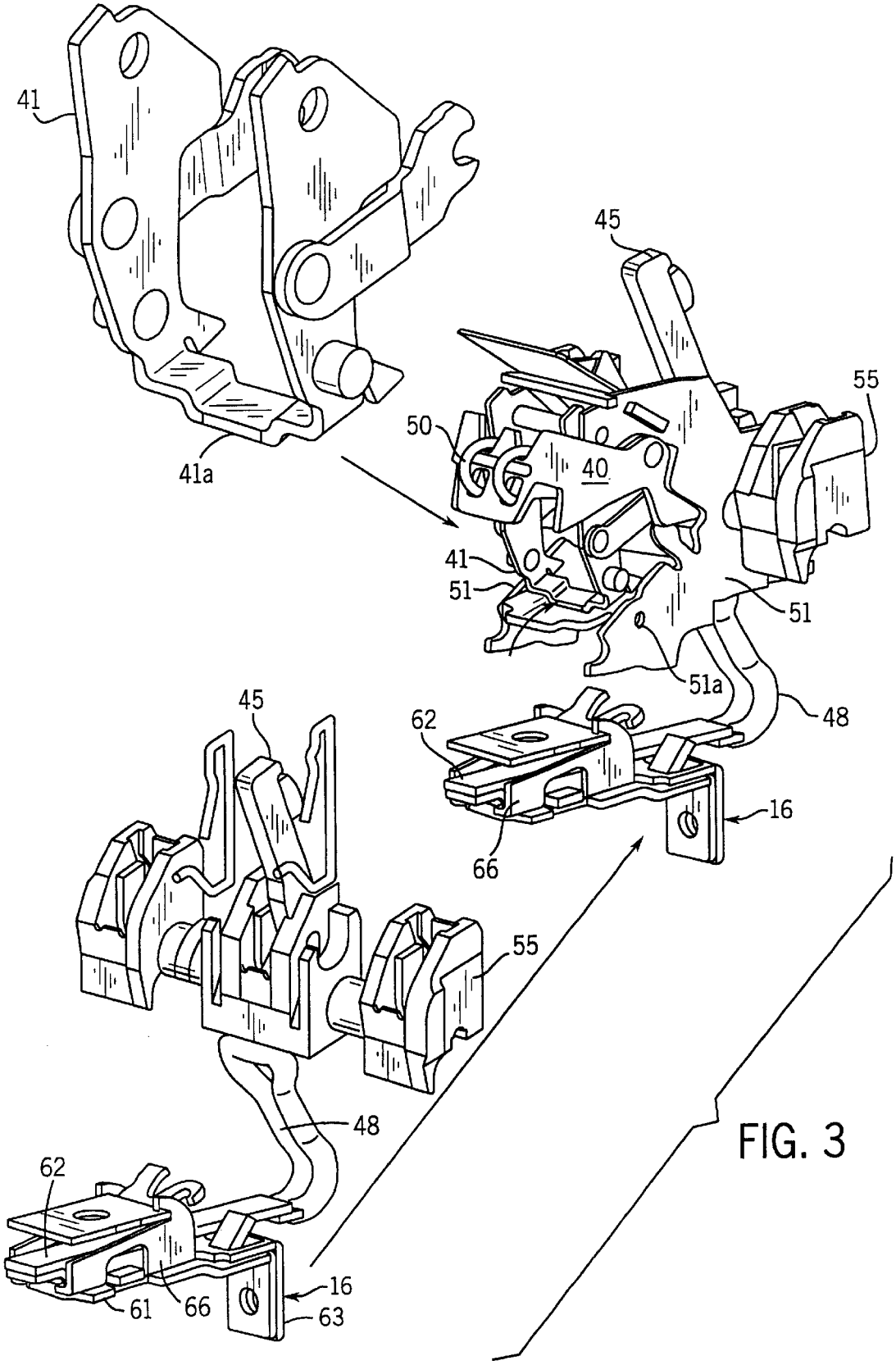
FIG. 3 is an exploded isometric drawing of the operating mechanism, contact structure and bi-metal trip unit of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bi-metallic element 62 by a flexible conductor 48 (e.g. braided copper strand). As shown in FIG. 3, current flows from the flexible conductor 48 through the bi-metallic element 62 to a connection at the top of the bi-metallic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41a which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

Figure 4:
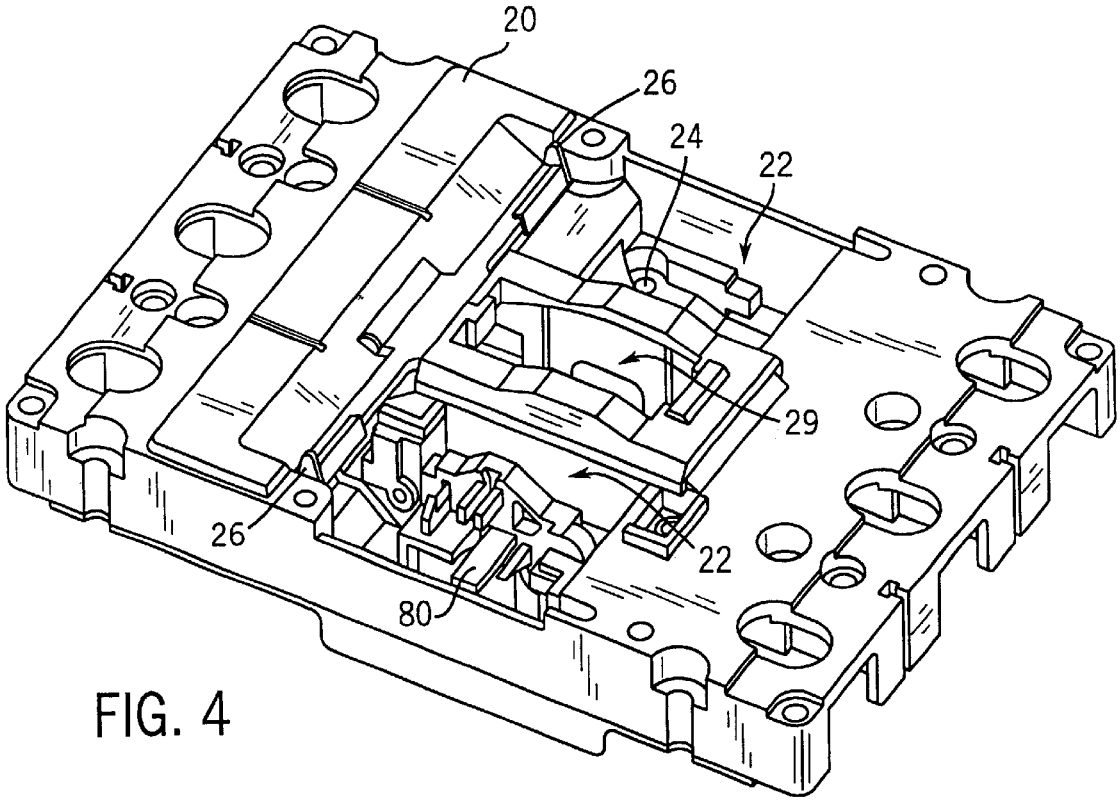
FIG. 4 is an illustration of the circuit breaker main cover for the circuit breaker shown in FIG. 1.

FIG. 4 illustrates the breaker cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40 or the intermediate latching 52. Various accessories 80 can be mounted in the accessory compartment 22 to perform various functions. Some accessories, such as a shunt trip, will trip the circuit breaker 10, upon receiving a remote signal, by pushing the trip bar 54 in a counter clockwise direction causing release of the intermediate latch 52 of the operating mechanism 40. The shunt trip has a member protruding through one of the openings in the accessory socket 22 and engages the operating mechanism 40 via the trip bar 54. Another accessory, such as an auxiliary switch, provides a signal indicating the status of the circuit breaker 10, e.g. "on" or "off". When the auxiliary switch assembly is nested in the accessory socket 22, a member on the switch protrudes through one of the openings 24 in the socket 22 and is in engagement with the operating mechanism 40, typically the cross bar 55. Multiple switches can be nested in one accessory socket 22 and each switch can engage the operating mechanism through a different opening 24 in the socket 22.

The circuit breaker cover 20 has a latching protrusion 26 mounted in each accessory socket 22. The preferred embodiment has latching protrusion attached to the upper edge of the accessory socket 22 (See FIGS. 4, 5 and 7). The latching protrusion can be heat staked in place, riveted or attached with an adhesive such as epoxy. One alternative embodiment of the present breaker cover 20 has the latching protrusion molded with an accessory base 84 which engages a detent in the accessory socket 22.

Each accessory socket also has a wire channel 27 for routing signal and power wires to the individual accessory 80. In the preferred embodiment the wires pass through the wire channel 27 in the breaker cover 20 into a separate wire channel in the housing 22 of the circuit breaker 10 and then to a remote site for further connection.

While the embodiment illustrated in the Figures and described above are presently preferred, it shall be understood that these embodiments are offered by way of example only. The invention is not intended to be limited to any particular embodiment, but is intended to extend to various modifications that nevertheless fall within the scope of the appended claims. For example, other types of accessories can be nested within the accessory sockets. It is also contemplated that a resilient member on the accessory engages a detent in the accessory sockets. It is also contemplated that the trip mechanism with the bi-metal trip unit or an electronic trip unit, and load terminal be housed in a separate housing capable of mechanically and electrically connecting to a housing containing the operating mechanism and line terminal thereby providing for a quick and easy change of current ratings for an application of the circuit breaker contemplated herein. Other modifications will be evident to those with ordinary skill in the art.

We claim:

1. A molded case circuit breaker comprising:

a molded housing including a main breaker cover;

a first terminal and a second terminal mounted in the case;

a stationary contact electrically coupled to the first terminal;

a moveable contact electrically coupled to the second terminal;

an operating mechanism having a pivoting member moveable between an ON position, an OFF position and a TRIPPED position, wherein the pivoting member is coupled to the moveable contact;

an intermediate latching mechanism mounted in the housing and coupled to the operating mechanism; and a trip unit coupled to the moveable contact and the second terminal with the trip unit in selective operative contact with the intermediate latching mechanism; and, an accessory compartment system, the accessory compartment system comprising:

an accessory socket formed in the main breaker cover on either side of an opening for the pivoting member, with the accessory socket in communication with the housing and configured to accept a plurality of different types of accessories;

a latching protrusion in the socket wherein, the protrusion latches an accessory; and, an accessory cover sized to cover the accessory mounted in the accessory socket.

2. The circuit breaker of claim 1, including at least another accessory socket formed in the circuit breaker cover on another side of the pivoting member, with the accessory socket having a latching protrusion for engaging another accessory and the accessory cover sized to cover the additional accessory socket.

3. The circuit breaker of claim 2, wherein the cover is sized to cover all accessory sockets on each side of the opening for the pivoting member and allow the pivoting member to operate.

4. The circuit breaker of claim 2, wherein each accessory socket has a plurality of openings positioned in the socket to facilitate coupling of an accessory with the operating mechanism and the intermediate latching mechanism in the housing.

5. The circuit breaker of claim 4, wherein the plurality of openings are positioned in the socket to facilitate simultaneous coupling of an accessory with different parts of the operating mechanism in the housing.

6. The circuit breaker of claim 4, wherein an accessory is mounted in one of the sockets, with the accessory having a member protruding through at least one of the openings in the socket and in engagement with the operating mechanism in the housing.

7. The circuit breaker of claim 6, wherein multiple accessories are mounted in the accessory sockets.

8. A cover for a molded case circuit breaker having an operating mechanism and an intermediate latching mechanism, the cover comprising:

a substantially planar member having a central opening;

an accessory compartment formed in the planar member on either side of the opening, with the accessory compartment configured to accept a plurality of different types of circuit breaker accessories and having a plurality of holes; and, a latching protrusion in the accessory compartment for engaging a circuit breaker accessory, wherein a circuit breaker accessory nested in the accessory compartment is in contact with one of the operating mechanism and the intermediate latching mechanism.

9. The cover of claim 8, including at least another accessory compartment formed in the planar member on another side of the opening.

10. The cover of claim 9, wherein the planar member is sized to cover at least a three-pole circuit breaker.

11. The cover of claim 9, including an accessory cover sized to cover all of the accessory compartments on each side of the opening and allow the circuit breaker to operate.

12. A circuit breaker comprising:

a housing including a base;

a means for connecting a load to the breaker, mounted in the housing;

a means for connecting an electrical line to the breaker, mounted in the housing;

a stationary contact electrically coupled to the means for connecting and electrical line;

a moveable contact coupled to a means for operating mounted in the housing and having a pivoting member moveable between an ON position and OFF position, and a TRIPPED position, with the pivoting member coupled to the moveable contact and with the means for operating coupled to an intermediate means for latching the means for operating;

a means for tripping coupled to the moveable contact and the means for connecting a load with the means for tripping in selective operative contact with the intermediate means for latching; and, a means for covering the several means mounted in the housing and closing the housing with the means for covering including a means for nesting an accessory formed on either side of an opening in the means for covering for the pivoting member, with the means for nesting having a means for securing an accessory.

13. The circuit breaker of claim 12, wherein means for nesting an accessory is in communication with the means for operating and configured to accept a plurality of different types of accessories.

14. The circuit breaker of claim 13, including at least another means for nesting formed in the means for covering on another side of the opening for the pivoting member.

15. The circuit breaker of claim 14, including a cover sized to cover all the means for nesting on each side of the opening for the pivoting member and allow the pivoting member to operate.

16. The circuit breaker of claim 15, wherein each means for nesting has a plurality of openings positioned in the means for nesting to facilitate coupling of an accessory with the means for operating mounted to the housing.

17. The circuit breaker of claim 16, wherein the plurality of openings are positioned in the means for nesting facilitate simultaneous coupling of an accessory with different parts of the means for operating mounted in the housing.

18. The circuit breaker of claim 17, wherein an accessory is mounted in one of the means for nesting, with the accessory having a means for engaging protruding through at least one of the openings in the means for nesting and in engagement with the means for operating mounted in the housing.

19. The circuit beaker of claim 18, wherein multiple accessories are mounted in the means for nesting.

* * * * *